US007391984B2

(12) United States Patent
Sugita et al.

(10) Patent No.: US 7,391,984 B2
(45) Date of Patent: Jun. 24, 2008

(54) FIXING DEVICE

(75) Inventors: Shinji Sugita, Nara (JP); Tatsuya Shinkawa, Nara (JP); Takashi Yamanaka, Nara (JP); Kan Mukai, Nara (JP); Kouji Wakamoto, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 141 days.

(21) Appl. No.: 11/325,488

(22) Filed: Jan. 5, 2006

(65) Prior Publication Data

US 2006/0159479 A1 Jul. 20, 2006

(30) Foreign Application Priority Data

Jan. 18, 2005 (JP) ..... 2005-010526

(51) Int. Cl.
*G03G 15/20* (2006.01)

(52) U.S. Cl. ..... 399/69; 399/327

(58) Field of Classification Search ..... 399/69, 399/70, 71, 327, 328
See application file for complete search history.

(56) References Cited

U.S. PATENT DOCUMENTS 6,026,272 A * 2/2000 Kusaka et al. ..... 399/327

FOREIGN PATENT DOCUMENTS

JP 60-169876 9/1985
JP 2003-29563 1/2003

* cited by examiner

*Primary Examiner*—Hoang Ngo
(74) *Attorney, Agent, or Firm*—Nixon & Vanderhye P.C.

(57) ABSTRACT

The present invention provides a fixing device for fixing a toner image formed on paper by sandwiching the paper in a nip region between a heating roller and a pressing roller and pressing the paper while heating the paper to a fixing temperature. This fixing device includes a cleaning roller that is in contact with the pressing roller, and temperature control means that sets a temperature of the heating roller to a cleaning temperature that is higher than the fixing temperature.

12 Claims, 7 Drawing Sheets

FIG.7

| | conventional example (℃) | the present embodiment (℃) | notes |
|---|---|---|---|
| fixing lower limit temperature te | tc − (20~40) | tc − (20~40) | minimum temperature ensuring ability of fixing printed paper |
| fixing temperature tc | 180~200 | 180~200 | appropriate fixing temperature |
| heat resistance temperature tg | about 240 | about 240 | temperature for breaking heating temperature |
| energy-saving temperature th | about 100 | about 100 | between toner melting temperature and softening temperature |
| cleaning temperature tf | − | tc + (10~20) | temperature for promoting increase of surface temperature of pressing roller |

FIXING DEVICE

BACKGROUND OF THE INVENTION

This application claims priority under 35 U.S.C. § 119(a) on Patent Application No. 2005-10526 filed in Japan on Jan. 18, 2005, the entire contents of which are hereby incorporated by reference.

The present invention relates to a fixing device that can be applied to electrophotographic or electrostatic recording image forming apparatuses or other types of image forming apparatuses.

Conventionally, a fixing device of these types fixes a toner image formed on paper by sandwiching the paper in a nip region between a heating roller and a pressing roller so that the paper is pressed while being heated to fixing temperature, and is disclosed in, for example, JP S60-169876A (hereinafter, referred to as "Patent Document 1"). In Patent Document 1, a plurality of fixing conductions with varied fixing temperatures, pressing forces and the like are prepared, and an appropriate condition is selected among the fixing conditions, depending on the kind of the recording material, and is set. Thus, it is possible to maintain good fixability, regardless of the kind of the recording material.

In recent years, toner containing resin as the main component and having a softening temperature of 50 to 70° C. and a melting temperature of about 120° C. has been used for image forming apparatuses. Therefore, for example, the fixing temperature on the surface of the heating roller is set to 160 to 200° C., and the temperature on the surface of the pressing roller is set to a temperature of not less than 120° C., which is the melting temperature. Thus, the toner on the paper is melted and fixed.

On the other hand, the commercial power supplied to private households has an upper limit of 1500 W (100 V, 15 A). Therefore, the power that the fixing device can consume is limited up to about 700 to 900 W, which affects the processing in the fixing device.

Therefore, there is an attempt to use a heating roller and a pressing roller made of aluminum or iron and having a surface layer with a thickness of about 0.15 to 2.0 mm, instead of the conventional heating roller and pressing roller whose surface layers have a thickness of about 5 to 10 mm, in order to improve the thermal conductivity so that the warming-up time of the fixing device can be reduced.

However, even if the thickness of the heating roller and the pressing roller is reduced and the warming-up time of the fixing device is reduced, the fixing process speed and the paper conveying speed are not increased. This is because in a state in which the consumption power of the fixing device is limited, the heat amount for heating and melting the toner image on the paper is also limited, and therefore the number of paper sheets that can be subjected to fixing process per unit time is limited so that the upper limits of the fixing process speed and the paper conveying speed are spontaneously determined.

Furthermore, even if the upper limits of the fixing process speed and the paper conveying speed are determined, when a large number of paper sheets are subjected to fixing process continuously, the heat of the heating roller and the pressing roller is taken away by the paper or the toner, so that the temperatures of the heating roller and the pressing roller are reduced, and the toner on the paper sheets is not heated sufficiently. At this time, even if most of the toner on the paper is fixed to the paper, the toner that is in direct contact with the surface of the heating roller tends to be attached to the heating roller. The residual toner that is attached to the heating roller is melted on the surface of the heating roller before reaching again the nip region through rotation of the heating roller, and is attached to a peripheral member such as a paper remover or a temperature sensor so that the peripheral member is soiled or the toner is transferred to the pressing roller.

Therefore, a cleaning roller is brought in contact with the heating roller or the pressing roller so that the residual toner on the heating roller and the pressing roller is transferred to the cleaning roller to clean the heating roller and the pressing roller.

However, when the temperature of the heating roller is reduced, the temperature of the pressing roller is further reduced. In this state, the residual toner of the pressing roller is not uniformly attached onto the circumferential surface of the cleaning roller, and the residual toner is attached in the granular form non-uniformly onto the circumferential surface of the cleaning roller.

When the residual toner is attached in the granular form non-uniformly onto the circumferential surface of the cleaning roller, the residual toner tends to be detached and fall off from the cleaning roller due to even the smallest vibration or impact. As a result, the detached and fallen residual toner can soil the paper or the peripheral member. Alternatively, the residual toner is reverse-transferred from the cleaning roller to the pressing roller, and the reverse-transferred residual toner soils the paper.

In order to solve such a problem of the cleaning roller for the pressing roller, it can be thought to perform fine temperature management of the fixing device. However, conventionally, it can only be performed to set selectively a plurality of fixing conditions with varied fixing temperatures or pressing forces as shown in Patent Document 1, and reduction in the temperatures of the heating roller and the pressing roller is not taken into consideration, so that this problem remains unsolved.

Therefore, the present invention is carried out in view of the above-described conventional problem, and it is an object of the present invention to provide a fixing device that can allow toner to be attached uniformly onto the circumferential surface of the cleaning roller, and prevents toner from being detached from the cleaning roller.

SUMMARY OF THE INVENTION

In order to solve the above-described problem, the present invention is a fixing device for fixing a toner image formed on paper by sandwiching the paper in a nip region between a heating roller and a pressing roller and pressing the paper while heating the paper to a fixing temperature, including a cleaning roller that is in contact with the pressing roller; and temperature control means that sets a temperature of the heating roller to a cleaning temperature that is higher than the fixing temperature.

According to the fixing device of the present invention, the temperature of the heating roller is set to a cleaning temperature that is higher than the fixing temperature by the temperature control means, and therefore the pressing roller also has a high temperature due to the thermal conductivity from the heating roller. Therefore, even if the residual toner is attached in granular form non-uniformly onto the circumferential surface of the cleaning roller, the residual toner on the circumferential surface of the cleaning roller is melted and crushed by the rotational contact with the temperature pressing roller, which has a high temperature, so that the residual toner on the circumferential surface of the cleaning roller can have a uniform thickness. This makes it difficult that the residual toner is detached from the cleaning roller so that the residual toner can be suppressed from being detached and falling off or being reverse-transferred to the pressing roller. As a result, the peripheral members or the paper cannot be soiled with the residual toner. Furthermore, since the temperature of the heating roller is set to the cleaning temperature that is higher than the fixing temperature by the temperature control means, it is sufficient to control the heater of the heating roller, which can be performed without making the configuration complex or increasing the cost.

In the above configuration, the cleaning temperature may be a temperature at which toner attached to the pressing roller is melted due to thermal conductivity between the heating roller and the pressing roller, and may be lower than a heat resistance temperature of the fixing device.

In this case, the cleaning temperature is set to be lower than a heat resistance temperature of the fixing device, and therefore setting the cleaning temperature does not deteriorate the cleaning roller, the heating roller and the pressing roller.

Furthermore, in the above configuration, the temperature control means may set the cleaning temperature that is increased from the fixing temperature after a process for fixing a toner image on paper is finished.

In this case, since the cleaning temperature that is increased from the fixing temperature is set after a process for fixing a toner image on paper is finished, even if the residual toner is attached in granular form non-uniformly onto the circumferential surface of the cleaning roller at the time of fixing process, the residual toner on the circumferential surface of the cleaning roller is melted and crushed so that the residual toner on the circumferential surface of the cleaning roller has a uniform thickness after the fixing process is finished.

Furthermore, in the above configuration, the temperature control means may set the cleaning temperature that is increased from the fixing temperature when a standby mode of the fixing device is set after a process for fixing a toner image on paper is finished.

In this case, in the standby mode after the process for fixing a toner image on paper, the cleaning temperature that is increased from the fixing temperature is set, the standby mode can be utilized effectively.

Furthermore, in the above configuration, even if a process for fixing a toner image on paper is finished, it is not necessary for the temperature control means to set the cleaning temperature when a process for fixing a toner image on next paper is to be performed (i.e., the setting temperature by the temperature control means is maintained at the fixing temperature and it is not necessary to increase the temperature from the fixing temperature to the cleaning temperature).

In this case, even if a process for fixing a toner image on paper is finished, the cleaning temperature is not set when a process for fixing a toner image on next paper is to be performed. Therefore, setting the cleaning temperature does not affect the process for fixing a plurality of paper sheets successively.

In the above configuration, the cleaning temperature may be a temperature at which the temperature of the pressing roller becomes a temperature of not less than a fixing lower limit temperature due to thermal conductivity between the heating roller and the pressing roller.

In this case, the cleaning temperature is a temperature at which the temperature of the pressing roller becomes a temperature of not less than a fixing lower limit temperature due to thermal conductivity between the heating roller and the pressing roller, and therefore the residual toner on the circumferential surface of the cleaning roller is melted and crushed reliably so that the residual toner on the circumferential surface of the cleaning roller has a uniform thickness.

In the above configuration, the temperature control means may suspend setting control of the cleaning temperature when an energy-saving mode of the fixing device is set.

In this case, when the energy-saving mode of the fixing device is set, the setting control of the cleaning temperature is suspended. This prevents the setting control of the cleaning temperature, which is a high temperature, from being performed over a long time and prevents the peripheral members from deteriorating due to high temperatures, and ensures safety.

In the above configuration, during setting control of the cleaning temperature, the temperature control means may suspend setting control of the cleaning temperature in response to a request for a fixing process and may set the fixing temperature.

In this case, during setting control of the cleaning temperature, the setting control of the cleaning temperature is suspended in response to a request for a fixing process and the fixing temperature is set, and therefore the fixing process can be started rapidly.

In the above configuration, during setting control of the cleaning temperature, the heating roller and the pressing roller may be rotated.

In this case, during setting control of the cleaning temperature, the heating roller and the pressing roller are being rotated, and therefore, the cleaning roller is also rotated, the residual toner of the pressing roller is transferred and attached to the circumferential surface of the cleaning roller uniformly, and the residual toner is pressed against the circumferential surface of the cleaning roller. The cleaning roller may be rotated according to the pressing roller that is in contact with the cleaning roller.

In the above configuration, the coefficient of thermal conductivity of the surface of the cleaning roller may be higher than that of the surface of the pressing roller that is in contact with the cleaning roller.

In this case, since the coefficient of thermal conductivity of the surface of the cleaning roller may be higher than that of the surface of the pressing roller that is in contact with the cleaning roller, when the pressing roller is heated, the cleaning roller is also heated rapidly.

BRIEF DESCRIPTION OF THE DRAWINGS

FIG. 7 is a table showing collectively this embodiment (graph in FIG. 5) and the conventional example (graph in FIG. 6).

DESCRIPTION OF THE PREFERRED EMBODIMENTS

Hereinafter, embodiments of the present invention will be described with reference to the accompanying drawings.

Figure 1:
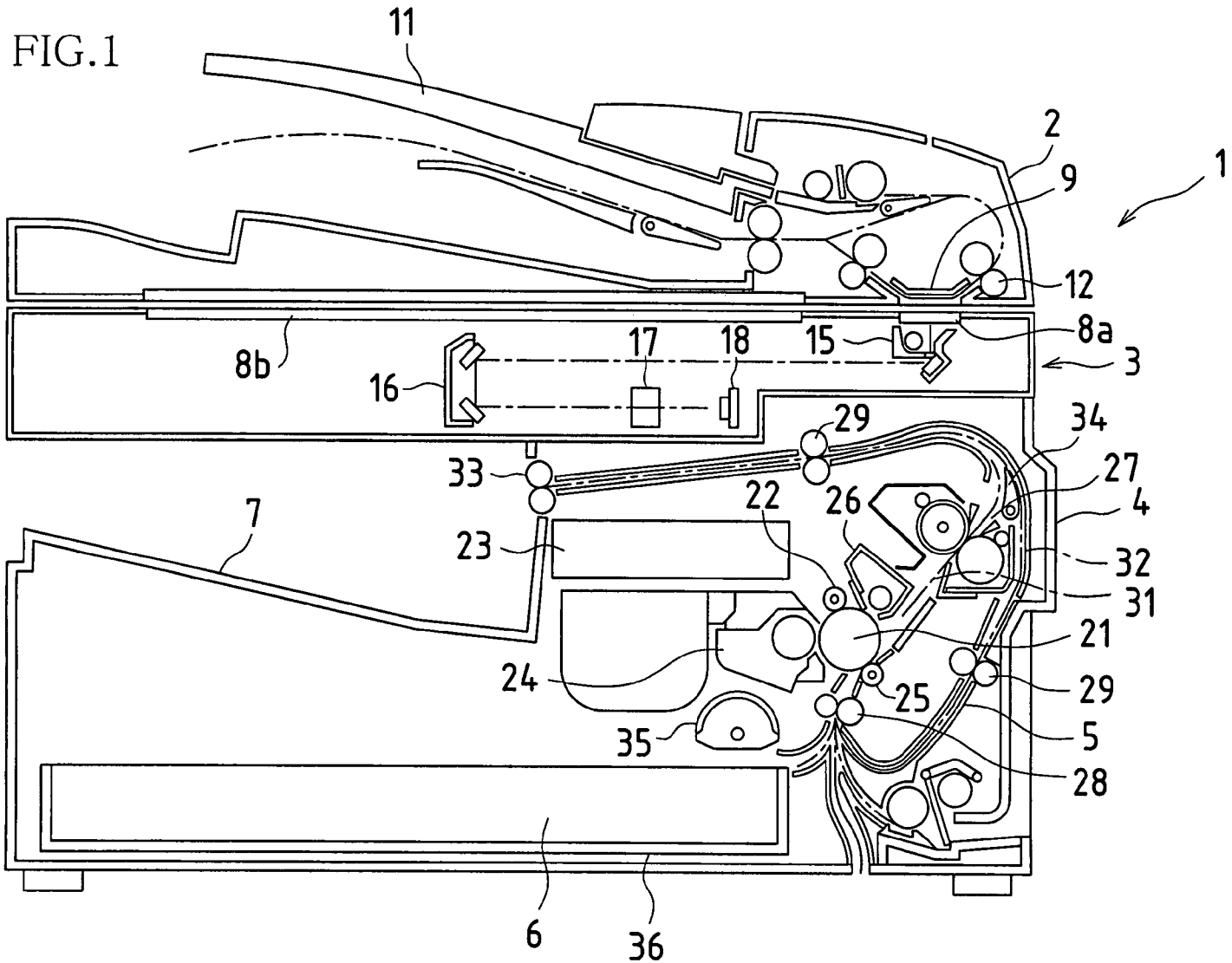
FIG. 1 is a side view showing an image forming apparatus to which one embodiment of a fixing device of the present invention is applied.
Figure 2:
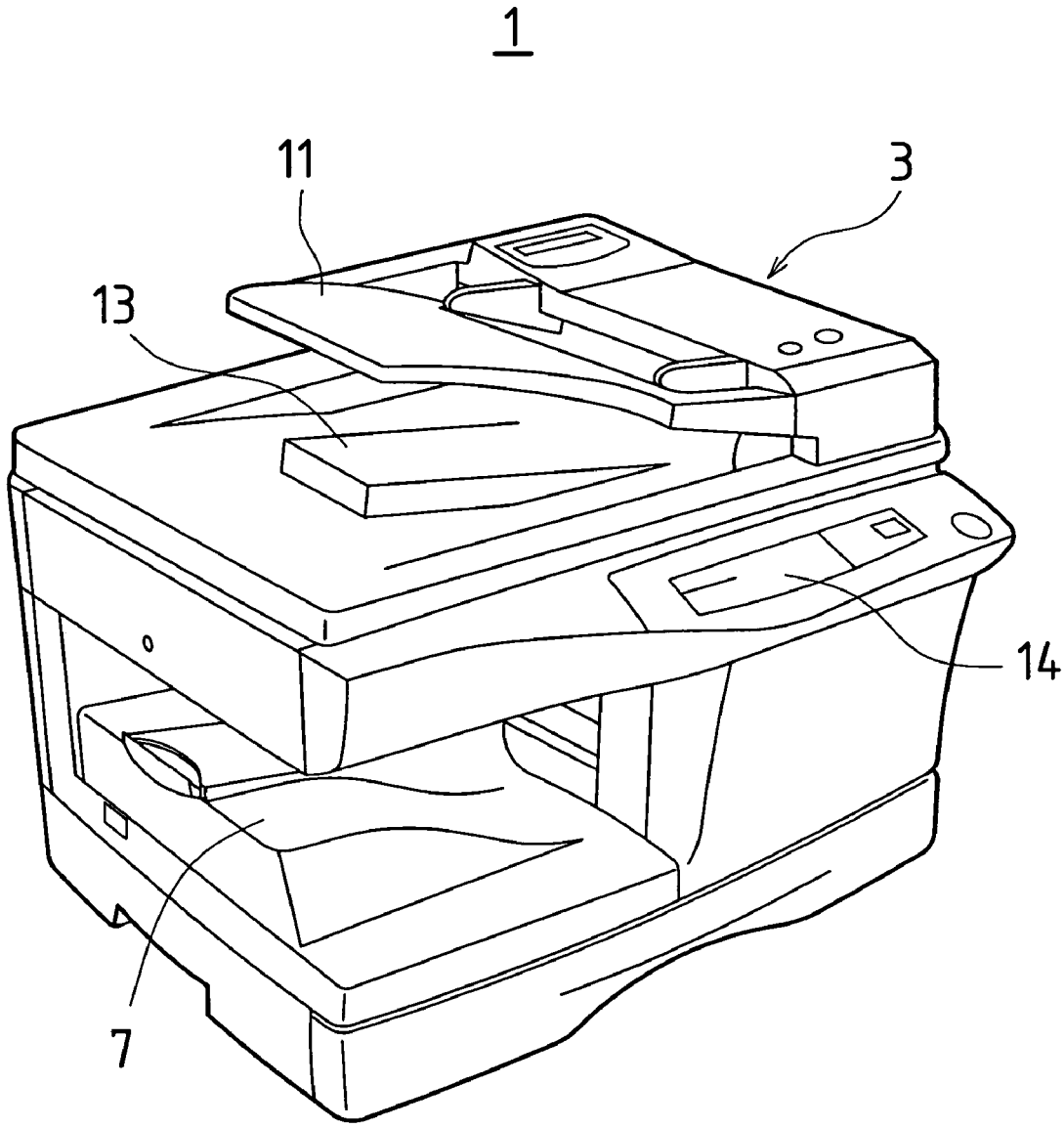
FIG. 2 is a perspective view showing the image forming apparatus of FIG. 1.

FIG. 1 is a side view showing an image forming apparatus to which one embodiment of a fixing device of the present invention is applied. FIG. 2 is a perspective view showing this image forming apparatus. The image forming apparatus 1 can perform selectively copy mode in which images in an original are read and printed on paper, facsimile mode in which images in an original are read and transmitted and images in an original are received and printed on paper, and printer mode in which images received through a network from an information terminal apparatus are printed on paper. The image forming apparatus 1 generally has a configuration including an original conveying portion 2, a reading portion 3, a printing portion 4, a paper conveying portion 5, a paper feed portion 6 and a paper discharge portion 7.

Next, the operation of the image forming apparatus 1 will be described by taking the copy mode as an example.

In the original conveying portion 2, when at least one original is set in an original setting tray 11, the original is extracted and conveyed from the original setting tray 11 page by page, and when the leading edge of the original has reached a PS roller 12, conveying the original is temporarily stopped and the leading edge of the original is made parallel to the PS roller 12. Then, a clutch between the PS roller 12 and a driving shaft is turned on in synchronization with an image recording operation by the printing portion 4 to drive the PS roller 12 to rotate so that the original is conveyed again by the PS roller 12 and the original is passed between a glass platen 8*a* and an original pressing plate 9.

In the reading portion 3, when conveying an original, the original is exposed to light by a first scanning unit 15, and light reflected from the original is guided to an imaging lens 17 by the first and second scanning units 15 and 16 so that an image is formed on a photoelectric transducer (hereinafter, referred to as CCD) 18 by the imaging lens 17. The CCD 18 scans repeatedly the original in the main scanning direction to read the image and outputs image data representing the original.

Furthermore, in the case where the original is placed on the glass platen 8*b*, the first and second scanning units 15 and 16 are moved while a predetermined speed relationship is maintained, the original on the glass platen 8*b* is exposed to light by the first scanning unit 15, light reflected from the original is guided to an imaging lens 17 by the first and second scanning units 15 and 16 so that an image is formed on the CCD 18 by the imaging lens 17.

Image data output from the CCD 18 are subjected to various types of image processing by a controller such as a microcomputer and then are output to the printing portion 4.

The printing portion 4 records the original represented by the image data on paper, and includes a photosensitive drum 21, a roller charging device 22, a laser scanning unit (hereinafter, referred to as LSU) 23, a development device 24, a transfer device 25, a cleaning device 26, and charge removal device (not shown) and a fixing device 27. The photosensitive drum 21 rotates in one direction, and after its surface is cleaned by the cleaning device 26 and the charge removal device, its surface is charged uniformly by the roller charging device 22. The LSU 23 modulates laser light in accordance with the image data, and the surface of the photosensitive drum 21 is scanned repeatedly with the laser light in the main scanning direction so that an electrostatic latent image is formed on the surface of the photosensitive drum 21. The development device 24 supplies toner to the surface of the photosensitive drum 21 to develop the electrostatic latent image so as to form a toner image on the surface of the photosensitive drum 21. The transfer device 25 transfers the toner image on the surface of the photosensitive drum 21 onto paper conveyed by the paper conveying portion 5. The fixing device 27 fixes the toner image on the paper by heating and pressing the paper. Thereafter, the paper is further conveyed to the paper discharge portion 7 and is discharged.

The paper conveying portion 5 includes PS rollers 28, conveying rollers 29, a conveying path 31, a reverse conveying path 32, paper discharge rollers 33, and a branch catch 34, which are used to convey paper. The conveying path 31 receives paper from the paper feed portion 6, and when the leading edge of the paper has reached the PS rollers 28, conveying the paper is temporarily stopped, and the leading edge of the paper is made parallel to the PS rollers 28. Thereafter, the paper is conveyed to the transfer device 25 of the printing portion 4 by the PS rollers 28, and further conveyed to the paper discharge portion 7. When recording an image also on the back face of the paper, the branch catch 34 is moved by rotation so that the branched path is switched from the conveying path 31 to the reverse conveying path 32, and then the paper is conveyed in the opposite direction from the conveying path 31 to the reverse conveying path 32. The reverse conveying path 32 receives the paper from the conveying path 31, the paper is returned to the PS rollers 28 in the conveying path 31 with its faces reversed. Thus, an image is also recorded on the back face of the paper. These conveying paths 31 and 32 are provided with a plurality of detection switches for detecting that the paper has passed so that control of conveying timing of the paper or the like is performed based on the detection of the detection switches.

The paper feed portion 6 accommodates unused paper and supplies the unused paper to the paper conveying portion 5, and includes a paper feed cassette 36. In the paper feed cassette 36, paper sheets are layered and accommodated and the paper sheets are extracted page by page by a semi-cylindrical pick-up roller 35 and conveyed. The paper is extracted from the paper feed cassette 36 and conveyed to the PS rollers 28.

Figure 3:
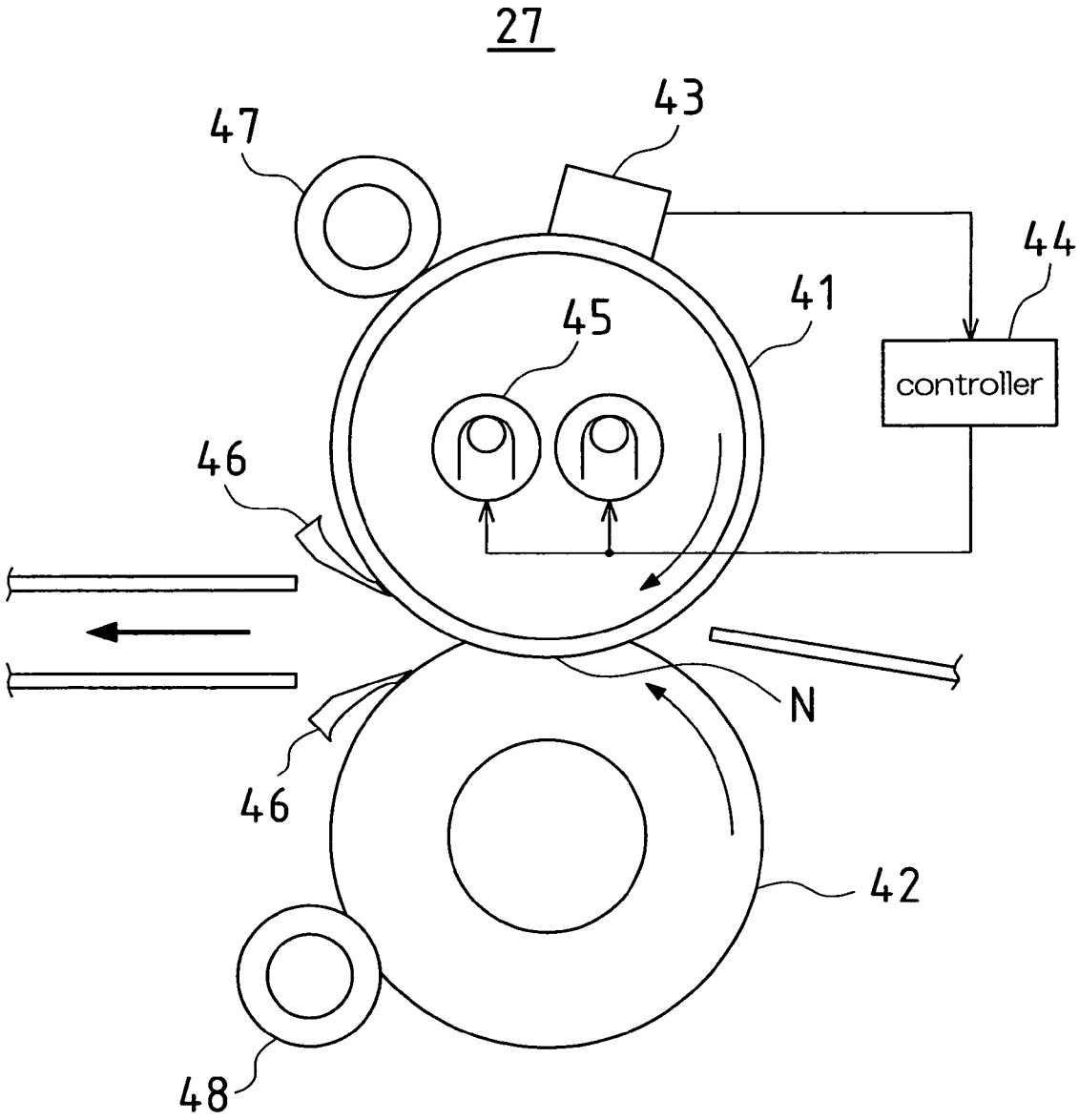
FIG. 3 is a side view showing a fixing device in the image forming apparatus of FIG. 1.

In the fixing device 27 of this embodiment, as shown in FIG. 3, a heating roller 41 and a pressing roller 42 are supported by shafts while the rollers are pressed against each other, and forms a nip region N in which the heating roller 41 and the pressing roller 42 sandwich the paper. A temperature sensor 43 is provided in the outer circumference of the heating roller 41 so that the surface temperature of the heating roller 41 is detected by the temperature sensor 43, and the surface temperature of the heating roller 41 is output to a controller 44 (including temperature control means in the present invention). When the controller 44 controls heat generation of a heater 45 that is inside the heating roller 41 so that the surface temperature of the heating roller 41 becomes a predetermined temperature when the surface temperature of the heating roller 41 is input.

In such a fixing device 27, the paper on which a toner image on the surface of the photosensitive drum 21 is transferred is led to the nit region N between the heating roller 41 and the pressing roller 42, and the paper is heated and pressed in the nip region N so that the toner image on the paper is fixed.

When a large number of paper sheets are subjected to fixing process successively, the heat of the heating roller 41 and the pressing roller 42 is taken away by the paper or the toner, so that the temperatures of the heating roller 41 and the pressing roller 42 are reduced, and the toner on the paper is not sufficiently heated. At this time, even if most of the toner on the paper is fixed firmly, the toner that is in direct contact in the surface of the heating roller 41 tends to be attached to the heating roller 41. Therefore, the residual toner attached to the heating roller 41 is melted on the surface of the heating roller 41 before reaching the nip region N again with the rotation of the heating roller 41 and attached to peripheral members such as the temperature sensor 43 and the paper remover 46 and soils the peripheral members. The residual toner attached to the heating roller 41 is transferred to the pressing roller 42 in the nip region N. Thus, the residual toner transferred to the pressing roller 42 also soils the peripheral members.

For this reason, as shown in FIG. 3, cleaning rollers 47 and 48 are pressed against the heating roller 41 and the pressing roller 42 so that the residual toner on the surfaces of the heating roller 41 and the pressing roller 42 is transferred to the cleaning rollers 47 and 48 so as to be removed, thereby cleaning the surface of the heating roller 41 and the pressing roller 42.

Regarding the heating roller 41, even if the temperatures of the heating roller 41 and the pressing roller 42 are reduced by the process for fixing a large number of paper sheets continuously, since the heating roller 41 is heated by the heater 45 directly, the surface temperature of the heating roller 41 is maintained at a temperature of not less than the melting temperature of the toner, so that the residual toner on the surface of the heating roller 41 is melted. Therefore, the residual toner is attached in a uniform thickness onto the circumferential surface of the cleaning roller 47, and there is no possibility that the residual toner on the circumferential surface of the cleaning roller 47 is detached and falls off.

Figure 4:
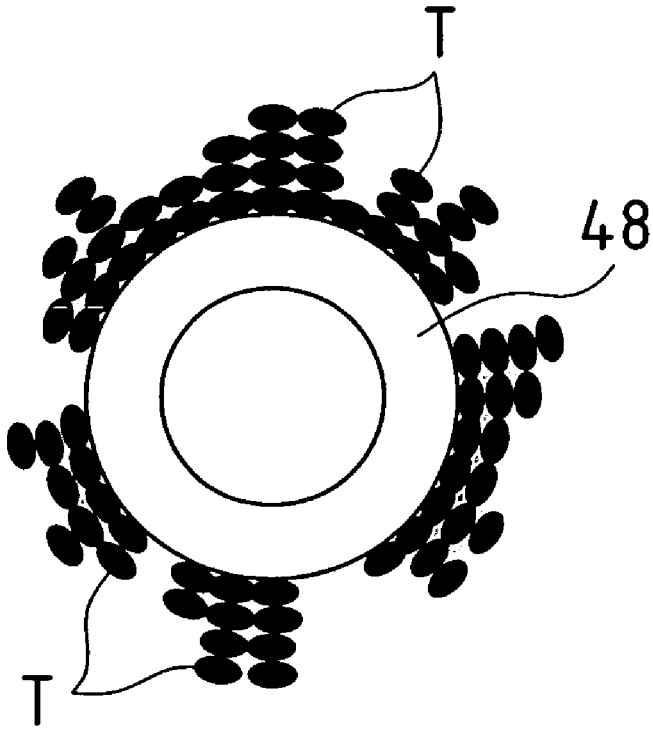
FIG. 4 is a view showing residual toner attached to a cleaning roller in the fixing device of FIG. 3.

However, since the pressing roller 42 is heated indirectly due to thermal conductivity from the heating roller 41, the surface temperature thereof is lowered than the toner melting temperature, and therefore the residual toner on the surface of the pressing roller 42 is not completely melted. Therefore, it is possible that the residual toner T in the granular form is attached non-uniformly on the circumferential surface of the cleaning roller 48, as shown in FIG. 4, and the residual toner tends to be detached and fall off from the cleaning roller 48.

Therefore, in this embodiment, in standby mode after the process for fixing paper, the surface temperatures of the heating roller 41 and the pressing roller 42 are controlled particularly so that the residual toner is attached uniformly on the circumferential surface of the cleaning roller 48. The "temperature control by the controller 44" here corresponds to setting the cleaning temperature that is increased from the fixing temperature in the present invention.

Next, the process for controlling the surface temperature of the heating roller 41 and the pressing roller 42 by the controller 44 will be described with reference to the graph of FIG. 5.

First, when the image forming apparatus 1 is started at a time TO, the controller 44 receives a surface temperature t1 of the heating roller 41 detected by the temperature sensor 43, and controls the heater 45 that is inside the heating roller 41 to be turned on or off such that the surface temperature t1 of the heating roller 41 becomes a fixing temperature tc (e.g., 180 to 200° C.). Thus, the surface temperature t1 of the heating roller 41 is increased from room temperature to a temperature higher than the toner softening temperature ta (e.g., 50 to 70° C.) and the toner melting temperature tb (e.g., 110 to 130° C.), further increased rapidly to the fixing temperature tc, and is maintained at this fixing temperature tc.

Furthermore, the heating roller 41 and the pressing roller 42 are started and rotated from the time T0. For example, the heating roller 41 is driven to rotate and the pressing roller 42 is accordingly rotated. The cleaning rollers 47 and 48 are also rotated accordingly. At this time, the surface temperature t2 of the pressing roller 42 is increased from room temperature due to the thermal conductivity between the heating roller 41 and the pressing roller 42 to a temperature higher than the toner softening temperature ta and the toner melting temperature tb, further increased to a temperature td (e.g., 120 to 150° C.) lower than the fixing temperature tc, and is maintained at this fixing temperature td.

The surface temperatures of the cleaning roller 47 and 48 are also increased due to the thermal conductivity between the cleaning rollers 47 and 48 and the heating roller 41 and the pressing roller 42. For example, the cleaning roller 47 and 48 have a surface layer having a thickness of 0.15 to 2.0 mm that is made of aluminum or iron and have better thermal conductivity than that of the heating roller 41 and the pressing roller 42, and therefore is heated rapidly by the thermal conductivity from the heating roller 41 and the pressing roller 42.

Then, when a process for printing paper by the image forming apparatus 1 is started at a time T1, the controller 44 controls the heater 45 that is inside the heating roller 41 to be turned on or off, based on the surface temperature t1 of the heating roller 41 detected by the temperature sensor 43, so as to maintain the surface temperature t1 of the heating roller 41 at the fixing temperature tc.

As described above, when a large number of paper sheets are subjected successively to a fixing process, the heat of the heating roller 41 and the pressing roller 42 is taken away by the paper or the toner, so that the temperatures of the heating roller 41 and the pressing roller 42 are reduced. For example, the surface temperature t1 of the heating roller 41 decreases to a temperature close to the fixing lower limit temperature te (tc−(20 to 40° C.)), which is the minimum temperature allowing a fixing process, and the surface temperature t2 of the pressing roller 42 becomes lower than the toner melting temperature tb.

Even in this state, the surface temperature t1 of the hating roller 41 is still maintained at a temperature higher than the toner melting temperature tb, and therefore the residual toner on the surface of the heating roller 41 is attached onto the circumferential surface of the cleaning roller 47. Consequently, the residual toner is attached to a uniform thickness onto the circumferential surface of the cleaning roller 47 and the residual toner on the circumferential surface of the cleaning roller 47 is not detached nor fall off.

On the other hand, the surface temperature t2 of the pressing roller 42 becomes lower than the toner melting temperature tb, and therefore the residual toner on the surface of the pressing roller 42 is attached to the circumferential surface of the cleaning roller 48 while being not melted. Therefore, as shown in FIG. 4, the residual toner T in granular form is attached to the circumferential surface of the cleaning roller 48 or attached non-uniformly, so that the residual toner T tends to be detached and fall off from the cleaning roller 48.

Then, when a process for printing paper by the image forming apparatus 1 is finished and the standby mode is started at a time T2, the controller 44 controls the heater 45 inside the heating roller 41 to be turned on or off based on the surface temperature t1 of the heating roller 41 detected by the temperature sensor 43 so that the surface temperature t1 of the heating roller 41 is increased to a cleaning temperature tf (tc+(10 to 20° C.)) higher than the fixing temperature tc while continuing to rotate the heating roller 41 and the pressing roller 42. At this time, due to the thermal conductivity between the heat roller 41 and the pressing roller 42, the surface temperature t2 of the pressing roller 42 is increased to a temperature higher than the toner melting temperature tb and the fixing lower limit temperature te and reaches the highest temperature. Then, the residual toner on the circumferential surface of the cleaning roller 48 is heated by a rotational contact with the pressing roller 42, which has a high temperature, so as to be crushed while melted, so that the residual toner on the circumferential surface of the cleaning roller 48 has a uniform thickness.

The cleaning temperature tf is set to a temperature not higher than the heat resistance temperature tg of the heat roller 41 and the pressing roller 42 so that the life of the heating roller 41 and the pressing roller 42 is not reduced. In view of not only the heat resistance temperature tg of the heating roller 41 and the pressing roller 42, but also the heat resistance temperatures of the cleaning rollers 47 and 48 and the peripheral members such as the temperature sensor 43 and the paper remover 46, the cleaning temperature tf may be set to a temperature not higher than these heat resistance temperatures.

The surface temperature t1 of the heating roller 41 is increased to the cleaning temperature tf only for a predetermined period of time, and when this predetermined period of time has passed, the controller 44 decreases the surface temperature t1 of the heating roller 41 to the fixing temperature tc based on the surface temperature t1 of the heating roller 41 detected by the temperature sensor 43 and maintains the surface temperature t1 at the fixing temperature tc.

Then, when the standby mode ends and the energy-saving mode is entered at a time T3, the controller 44 controls the heater 45 inside the heating roller 41 to be turned on or off based on the surface temperature t1 of the heating roller 41 detected by the temperature sensor 43 so that the surface temperature t1 of the heating roller 41 is reduced to an energy-saving temperature th while continuing to rotate the heating roller 41 and the pressing roller 42. Furthermore, when the energy-saving mode ends and the power-saving mode is entered at a time T4, the controller 44 stops the rotation of the heating roller 41 and the pressing roller 42 and turns off the heater 45 inside the heating roller 41 to stop heating the heating roller 41.

In this embodiment, even if the residual toner in granular form is attached non-uniformly onto the circumferential surface of the cleaning roller cleaning roller 48 during a printing process, when the printing process is finished and the standby mode is entered, the surface temperature t1 of the heating roller 41 is increased to the cleaning temperature tf, which is higher than the fixing temperature tc, so that the surface temperature t2 of the pressing roller 42 is increased to a temperature higher than the fixing lower limit temperature te, due to the thermal conductivity between the heating roller 41 and the pressing roller 42 and therefore, the residual toner on the circumferential surface of the cleaning roller 48 is crushed by melting with the rotational contact with the pressing roller 42, which has a high temperature, so that the residual toner on the circumferential surface of the cleaning roller 48 can have a uniform thickness. This makes it difficult that the residual toner is detached from the cleaning roller 48 so that the residual toner can be suppressed from being detached and falling off or being reverse-transferred to the pressing roller 42. As a result, the peripheral members or the paper cannot be soiled with the residual toner. Furthermore, since the surface temperature t1 of the heating roller 41 is set to the cleaning temperature tf, which is higher than the fixing temperature tc by the controller 44, it is sufficient to control the heater of the heating roller 41, which can be performed without making the configuration complex or increasing the cost.

Figure 6:
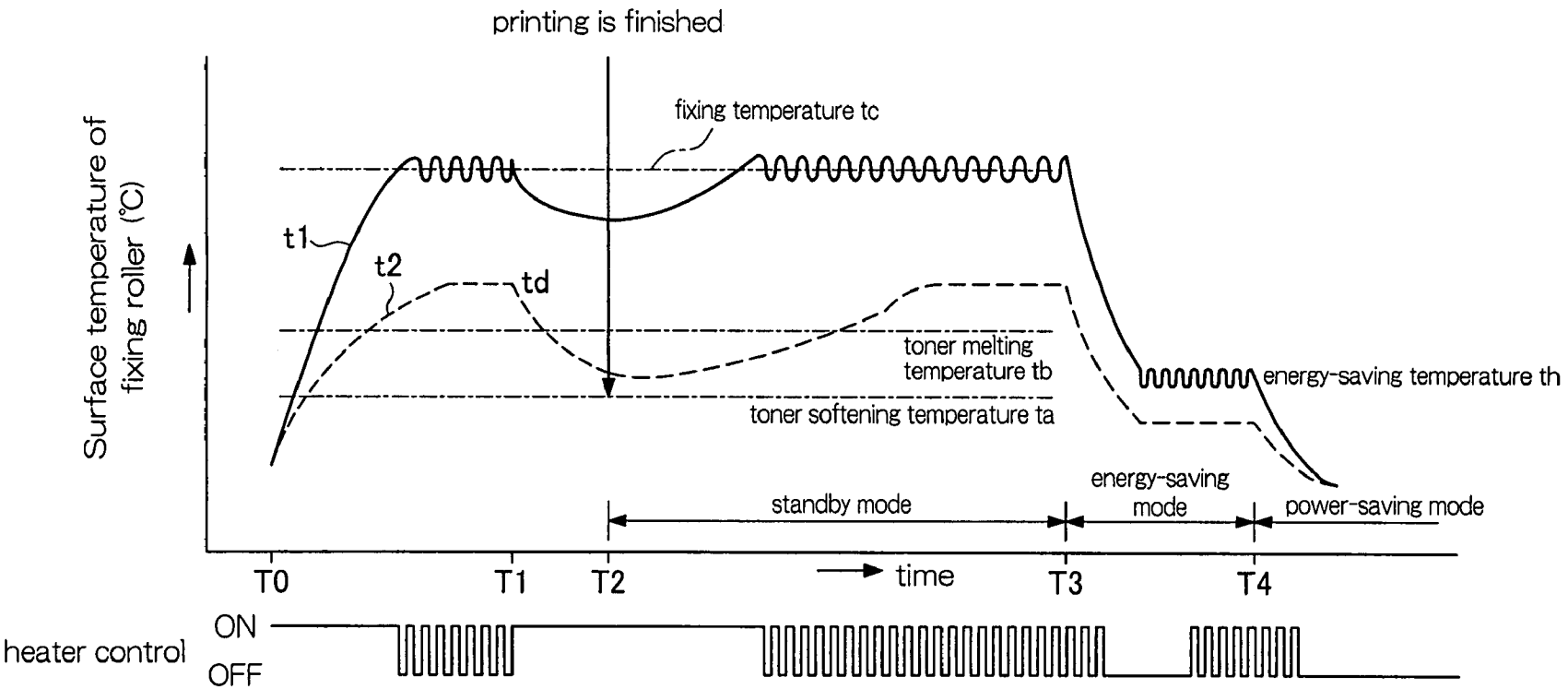
FIG.6 Prior Art
FIG. 6 is a graph showing transition of the surface temperature of the heating roller and the surface temperature of the pressing roller in a conventional fixing device.

On the other hand, in the conventional fixing device, as shown in the graph of FIG. 6, when a printing process is finished and the standby mode is entered, the surface temperature t1 of the heating roller 41 is only returned to the fixing temperature tc, so that the surface temperature t2 of the pressing roller 42 only slightly exceeds the toner melting temperature tb. Therefore, the residual toner in granular form on the circumferential surface of the cleaning roller 48 is not melted and crushed by the rotational contact with the pressing roller 42 and the residual toner on the circumferential surface of the cleaning roller 48 remains attached in granular form.

The table of FIG. 7 collectively shows this embodiment (graph of FIG. 5) and the conventional example (graph of FIG. 6). As evident from this table, in this embodiment, in the standby mode, not only the fixing temperature tc but also the cleaning temperature tf, which is higher than the fixing temperature tc, are set as the surface temperature t1 of the heating roller 41. On the other hand, in the conventional example, in the standby mode, only the fixing temperature tc is set as the surface temperature t1 of the heating roller 41. Therefore, in this embodiment, the surface temperature t2 of the pressing roller 42 is increased to a temperature higher than the fixing lower limit temperature te, and the residual toner on the circumferential surface of the cleaning roller 48 is melted and crushed by the rotation contact with the pressing roller 42, which has a high temperature, so that the residual toner on the circumferential surface of the cleaning roller 48 can have a uniform thickness. On the other hand, in the conventional example, the residual toner the circumferential surface of the cleaning roller 48 not melted and crushed by the rotational contact with the pressing roller 42 and the residual toner on the circumferential surface of the cleaning roller 48 remains attached in granular form.

Figure 5:
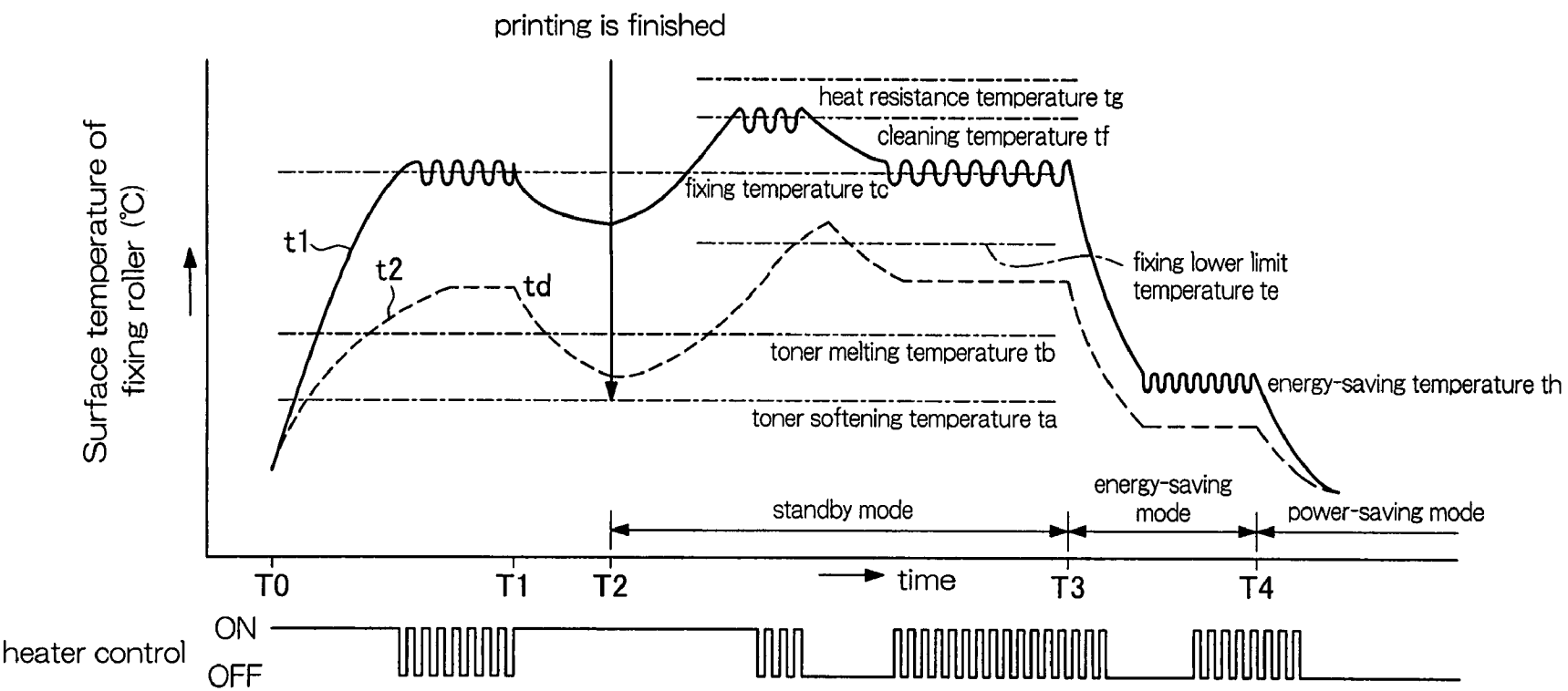
FIG. 5 is a graph showing transition of the surface temperature of the heating roller and the surface temperature of the pressing roller in the fixing device of FIG. 3.

Although not evidently shown in the graph of FIG. 5, even if a process for fixing a toner image on the paper is finished, the controller 44 does not set the cleaning temperature when a toner image on the next paper sheet has to be subjected to fixing (i.e., the setting temperature by the temperature control means is maintained at the fixing temperature tc and it is not necessary to increase the temperature from the fixing temperature tc to the cleaning temperature tf). Therefore, setting the cleaning temperature does not affect the process for fixing a plurality of paper sheets successively.

Furthermore, when, in the standby mode, the controller 44 cannot increase the surface temperature t1 of the heating roller 41 to the cleaning temperature tf, even if trying to increase it, and the energy-saving mode is entered with the temperature not increased, then setting control of the cleaning temperature tf is suspended. Therefore, setting control of the cleaning temperature tf, which is a high temperature, is prevented from being performed over a long period of time, so that the peripheral members can be prevented from being deteriorated by high temperatures, and safely can be ensured.

Furthermore, even if the controller 44 increases the surface temperature t1 of the heating roller 41 to the cleaning temperature tf in the standby mode, if a request to perform a fixing process is made, the controller 44 suspends setting control of the cleaning temperature tf in response to this request and sets the fixing temperature tc and allows smooth start of the fixing process.

The toner softening temperature ta, the toner melting temperature tb, the fixing temperature tc, the fixing lower limit temperature te, the heat resistance temperature tg and the cleaning temperature tf are all illustrative examples, and can be changed as appropriate depending on the materials of toner and the characteristics of the fixing device.

The present invention can be embodied and practiced in other different forms without departing from the gist and essential characteristics thereof. Therefore, the above-described embodiments are considered in all respects as illustrative and not restrictive. The scope of the invention is indicated by the appended claims rather than by the foregoing description. All variations and modifications falling within the equivalency range of the appended claims are intended to be embraced therein.

What is claimed is:

1. A fixing device for fixing a toner image formed on paper by sandwiching the paper in a nip region between a heating roller and a pressing roller and pressing the paper while heating the paper to a fixing temperature, comprising:

a cleaning roller that is in contact with the pressing roller; and temperature control means that sets a temperature of the heating roller to a cleaning temperature that is higher than the fixing temperature, wherein when the temperature of the heating roller is raised to the cleaning temperature by the temperature control means, a temperature of the pressing roller is raised higher than a fixing lower limit temperature which is lower than the fixing temperature.

2. The fixing device according to claim 1, wherein the cleaning temperature is a temperature at which toner attached to the pressing roller is melted due to thermal conductivity between the heating roller and the pressing roller, and is lower than a heat resistance temperature of the fixing device.

3. The fixing device according to claim 1, wherein the temperature control means sets the cleaning temperature that is increased from the fixing temperature after a process for fixing a toner image on paper is finished.

4. The fixing device according to claim 1, wherein the temperature control means sets the cleaning temperature that is increased from the fixing temperature when a standby mode of the fixing device is set after a process for fixing a toner image on paper is finished.

5. The fixing device according to claim 3 or 4, wherein even if a process for fixing a toner image on paper is finished, the temperature control means does not set the cleaning temperature when a process for fixing a toner image on next paper is to be performed.

6. The fixing device according to claim 1, wherein the cleaning temperature is a temperature at which the temperature of the pressing roller becomes a temperature not less than a fixing lower limit temperature due to thermal conductivity between the heating roller and the pressing roller.

7. The fixing device according to claim 1, wherein the temperature control means suspends setting control of the cleaning temperature when an energy-saving mode of the fixing device is set.

8. The fixing device according to claim 1, wherein during setting control of the cleaning temperature, the temperature control means suspends setting control of the cleaning temperature in response to a request for a fixing process and sets the fixing temperature.

9. The fixing device according to claim 1, wherein during setting control of the cleaning temperature, the heating roller and the pressing roller are rotated.

10. The fixing device according to claim 1, wherein the cleaning roller is rotated according to the pressing roller that is in contact with the cleaning roller.

11. The fixing device according to claim 1, wherein a coefficient of thermal conductivity of a surface of the cleaning roller is higher than that of a surface of the pressing roller that is in contact with the cleaning roller.

12. The fixing device of claim 1 wherein the fixing temperature is between 180 and 200° C.

* * * * *